US010090001B2

(12) United States Patent
Theverapperuma et al.

(10) Patent No.: US 10,090,001 B2
(45) Date of Patent: Oct. 2, 2018

(54) SYSTEM AND METHOD FOR PERFORMING SPEECH ENHANCEMENT USING A NEURAL NETWORK-BASED COMBINED SYMBOL

(71) Applicant: Apple Inc., Cupertino, CA (US)

(72) Inventors: Lalin S. Theverapperuma, Cupertino, CA (US); Vasu Iyengar, Pleasanton, CA (US); Sarmad Aziz Malik, Cupertino, CA (US); Raghavendra Prabhu, Culver City, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/225,595

(22) Filed: Aug. 1, 2016

(65) Prior Publication Data

US 2018/0033449 A1 Feb. 1, 2018

(51) Int. Cl.

| | |
|---|---|
| ***G10L 25/30*** | (2013.01) |
| ***G10L 21/0232*** | (2013.01) |
| ***G10L 25/72*** | (2013.01) |
| ***G10L 25/84*** | (2013.01) |
| ***G10L 21/028*** | (2013.01) |

(52) U.S. Cl.

CPC ..... *G10L 25/30* (2013.01); *G10L 21/028* (2013.01); *G10L 21/0232* (2013.01); *G10L 25/72* (2013.01); *G10L 25/84* (2013.01)

(58) Field of Classification Search

CPC ..... G10L 25/30; G10L 21/0232

See application file for complete search history.

(56) References Cited

U.S. PATENT DOCUMENTS

| | | | | |
|---|---|---|---|---|
| 5,737,485 | A * | 4/1998 | Flanagan | G10L 15/16 704/232 |
| 7,983,907 | B2 | 7/2011 | Visser et al. | |
| 2014/0337021 | A1* | 11/2014 | Kim | G10L 21/0208 704/228 |
| 2015/0006164 | A1 | 1/2015 | Lu et al. | |
| 2015/0086038 | A1 | 3/2015 | Stein et al. | |
| 2015/0339570 | A1 | 11/2015 | Scheffler | |

* cited by examiner

*Primary Examiner* — Ibrahim Siddo

(74) *Attorney, Agent, or Firm* — Womble Bond Dickinson (US) LLP

(57) ABSTRACT

Method of speech enhancement using Neural Network-based combined signal starts with training neural network offline which includes: (i) exciting at least one accelerometer and at least one microphone using training accelerometer signal and training acoustic signal, respectively. The training accelerometer signal and the training acoustic signal are correlated during clean speech segments. Training neural network offline further includes (ii) selecting speech included in the training accelerometer signal and in the training acoustic signal, and (iii) spatially localizing the speech by setting a weight parameter in the neural network based on the selected speech included in the training accelerometer signal and in the training acoustic signal. The neural network that is trained offline is then used to generate a speech reference signal based on an accelerometer signal from the at least one accelerometer and an acoustic signal received from the at least one microphone. Other embodiments are described.

21 Claims, 6 Drawing Sheets

SYSTEM AND METHOD FOR PERFORMING SPEECH ENHANCEMENT USING A NEURAL NETWORK-BASED COMBINED SYMBOL

FIELD

An embodiment of the invention relates generally to a system and method of speech enhancement using a deep neural network-based combined signal.

BACKGROUND

Currently, a number of consumer electronic devices are adapted to receive speech from a near-end talker (or environment) via microphone ports, transmit this signal to a far-end device, and concurrently output audio signals, including a far-end talker, that are received from a far-end device. While the typical example is a portable telecommunications device (mobile telephone), with the advent of Voice over IP (VoIP), desktop computers, laptop computers and tablet computers may also be used to perform voice communications.

When using these electronic devices, the user also has the option of using the speakerphone mode, at-ear handset mode, or a headset to receive his speech. However, a common complaint with any of these modes of operation is that the speech captured by the microphone port or the headset includes environmental noise, such as wind noise, secondary speakers in the background, or other background noises. This environmental noise often renders the user's speech unintelligible and thus, degrades the quality of the voice communication.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

Figure 1:
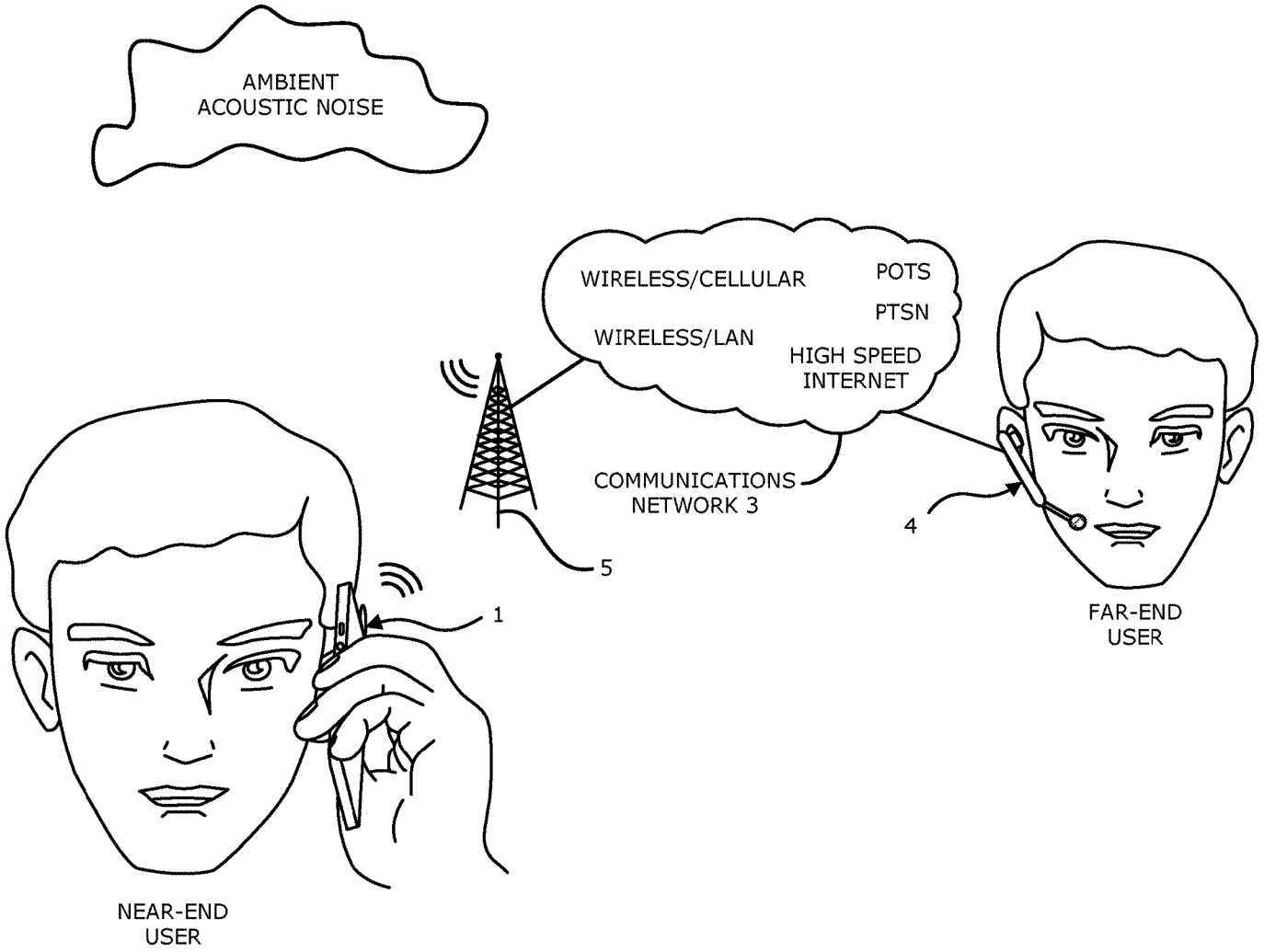
FIG. 1 depicts near-end user and a far-end user using an exemplary electronic device in which an embodiment of the invention may be implemented.

FIG. 1 depicts near-end user and a far-end user using an exemplary electronic device in which an embodiment of the invention may be implemented. The electronic device 10 may be a mobile communications handset device such as a smart phone or a multi-function cellular phone. The sound quality improvement techniques using double talk detection and acoustic echo cancellation described herein can be implemented in such a user audio device, to improve the quality of the near-end audio signal. In the embodiment in FIG. 1, the near-end user is in the process of a call with a far-end user who is using another communications device 4. The term "call" is used here generically to refer to any two-way real-time or live audio communications session with a far-end user (including a video call which allows simultaneous audio). The electronic device 10 communicates with a wireless base station 5 in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

While not shown, the electronic device 10 may also be used with a headset that includes a pair of earbuds and a headset wire. The user may place one or both the earbuds into his ears and the microphones in the headset may receive his speech. The headset 100 in FIG. 1 is shown as a double-earpiece headset. It is understood that single-earpiece or monaural headsets may also be used. As the user is using the headset or directly using the electronic device to transmit his speech, environmental noise may also be present (e.g., noise sources in FIG. 1). The headset may be an in-ear type of headset that includes a pair of earbuds which are placed inside the user's ears, respectively, or the headset may include a pair of earcups that are placed over the user's ears may also be used. Additionally, embodiments of the present disclosure may also use other types of headsets. Further, in some embodiments, the earbuds may be wireless and communicate with each other and with the electronic device 10 via BlueTooth™ signals. Thus, the earbuds may not be connected with wires to the electronic device 10 or between them, but communicate with each other to deliver the uplink (or recording) function and the downlink (or playback) function.

Figure 2:
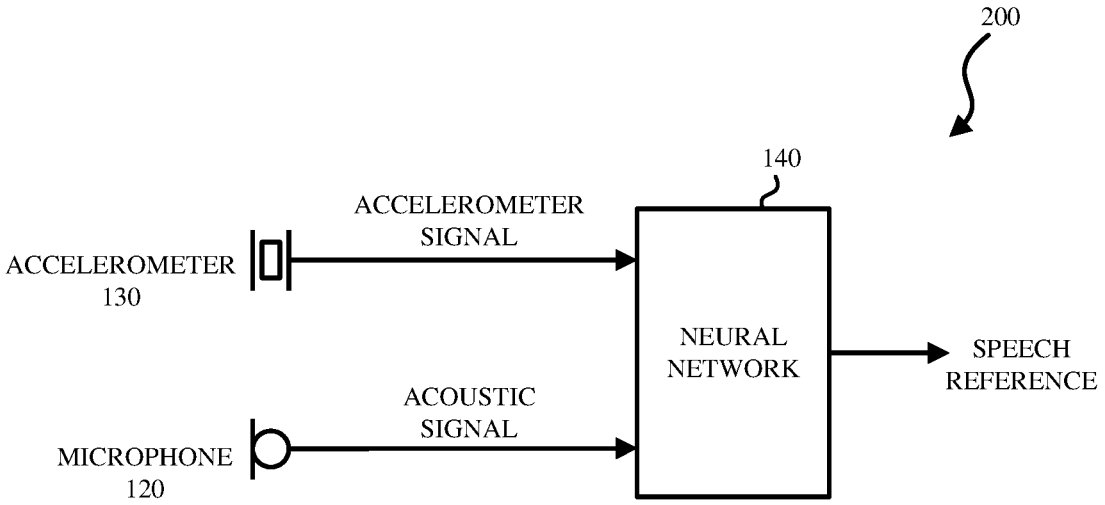
FIG. 2 illustrates a block diagram of a system for performing speech enhancement using a Neural Network based combined signal according to one embodiment of the invention.

FIG. 2 illustrates a block diagram of a system 200 for performing speech enhancement using a Neural Network based combined signal according to one embodiment of the invention. System 200 may be included in the electronic device 10 and comprises an accelerometer 130 and a microphone 120. While the system 200 in FIG. 2 includes only one accelerometer 130 and one microphone 120, it is understood that at least one of the accelerometers and at least one of the microphones in the electronic device 10 may be included in the system 200. It is further understood that the at least one accelerometer 130 and at least one microphone 120 may be included in a headset used with the electronic device 10.

The microphone 120 may be an air interface sound pickup device that converts sound into an electrical signal. As the near-end user is using the electronic device 10 to transmit his speech, ambient noise may also be present. Thus, the microphone 120 captures the near-end user's speech as well as the ambient noise around the electronic device 10. Thus, the microphone 120 may receive at least one of: a near-end talker signal or ambient near-end noise signal. The microphone generates and transmits an acoustic signal.

The accelerometer 130 may be a sensing device that measures proper acceleration in three directions, X, Y, and Z or in only one or two directions. When the user is generating voiced speech, the vibrations of the user's vocal chords are filtered by the vocal tract and cause vibrations in the bones of the user's head which are detected by the accelerometer 130. In other embodiments, an inertial sensor, a force sensor or a position, orientation and movement sensor may be used in lieu of the accelerometer 130. The accelerometer 130 generates accelerometer audio signals (e.g., accelerometer signals), which may be band-limited microphone-like audio signal. For instance, in one embodiment, while the acoustic microphone 120 captures the full-band, the accelerometer 130 may be sensitive to (and capture) frequencies between 20 Hz-800 Hz. Similar to the microphone 120, the accelerometer 130 may also capture the near-end user's speech and the ambient noise around the electronic device 10. Thus, the accelerometer 130 receives at least one of: the near-end talker signal or the ambient near-end noise signal. The accelerometer generates and transmits an accelerometer signal.

In one embodiment, the accelerometer signals being generated by the accelerometer 130 may provide a strong output signal during the near-end user's speech while not providing a strong output signal during ambient background noise. Accordingly, the accelerometer 130 provides additional information to the information provided by the microphone 120. However, the accelerometer signal may fail to capture room impulse response and the accelerometer 130 may also produces many artifacts, especially in wind and handling noise.

While not shown, in one embodiment, a beamformer may also be included in system 200 to receive the acoustic signals from a plurality of microphones 120 and create beams which can be steered to a given direction by emphasizing and deemphasizing selected microphones 120. Similarly, the beams can also exhibit or provide nulls in other given directions. Accordingly, the beamforming process, also referred to as spatial filtering, may be a signal processing technique using the acoustic signals from the microphones 120 for directional sound reception.

When the power of the environmental noise is above a given threshold or when wind noise is detected in the microphone 120, the acoustic signals captured by the microphone 120 may not be adequate. Accordingly, in one embodiment of the invention, rather than only using the acoustic signal from the microphone 120, the system 200 includes a neural network 140 that receives both the acoustic signal from the microphone 120 and the accelerometer signal from the accelerometer 130 to generate a neural network-based combined signal. This neural network-based combined signal is a speech reference signal.

Current spectral blenders introduce artifacts due to stitching and combining the accelerometer signal and the acoustic signal. Accordingly, rather than perform spectral mixing of the accelerometer's 130 output signals and the acoustic signals received from microphone 120, the neural network 140 is trained offline, using a training accelerometer signal from the accelerometer 130 and a training acoustic signal from the microphone 120 which are correlated and generated during clean speech segments, to provide spatial localization of features, weight sharing and subsampling of hidden units.

The training accelerometer signals and training acoustic signals that are correlated during clean speech segments are used to train the neural network 140. In one embodiment, training signals include (i) 12 accelerometer energy bins and 64 bins of noisy input signals and (ii) 64 bins of clean microphone (acoustic) signals. The neural network 140 trains on these two time frequency distributions, i.e., speech distributions and correlated accelerometer distributions. In one embodiment, a plurality of training accelerometer signals and a plurality of training acoustic signals used to train the neural network 140 offline.

In one embodiment, offline training of the neural network 140 may include exciting the accelerometer 130 and the microphone 120 using a training accelerometer signal and a training acoustic signal, respectively. The neural network 140 may select speech included in the training accelerometer signal and in the training acoustic signal and spatially localize the speech by setting a weight parameter in the neural network 140 based on the selected speech included in the training accelerometer signal and in the training acoustic signal.

Once the neural network 140 is trained offline, the neural network 140 may be used to generate the speech reference signal. The neural network 140 is, for example, a multilayer perception (MLP) neural network or a convolution deep neural network (CDNN). The neural network 140 may also be a convolutional auto-encoder.

A typical deep neural network mapping function can be described by a equation of the following form:

$$X[n,k]_{i+1}=f(X[n,k]_i W_i+b_i) \tag{1}$$

$f$ is a network of nonlinear sigmoid, tan h, relu functions, with multiple layers of connections (i-layer subscripts). W is the weight matrix for each layer. X[r,k] is the input to the network, i.e., $X[r,k]_o=X[r,k]$.

In the CDNN embodiment, input layer to the neural network 140 is a 2D map, which include spectrograms of the accelerometer signal and the microphone signals, where time on x-axis, and frequency on y-axis. Feature maps are generated by convolving a section of the input layer with a kernel (K) using:

$$S[i,j]=(K*I)(i,j)=\Sigma_m\Sigma_n I[i-m,j-n]K[m,n] \tag{2}$$

S[i,j] is the output of this layer for one kernel (K).

The advantages of using a CDNN includes (i) the sparse interactions needed in CDNN, (ii) being able to use the same parameters for more than one function in the network (i.e., parameter sharing) and (iii) due to the special connections mapping each layer to similar region of the spectral map, geometric properties of the spectrum is maintained tightly though the network (i.e., equvariant representations).

In one embodiment, the neural network 140 is mapping two spectral plots: accelerometer and microphone to clean output signals. The transformation can be viewed as a convolutional auto-encoding. Nonlinear Principal component analysis (PCA)-like parameters consist of the center of the neural network 140.

In one embodiment, the neural network 140 is a CDNN able to learn a nonlinear mapping function between the two transducers, along with the latent phonetic structures, which is similar to a bandwidth extension, needed for reconstructing the high frequency phones.

In one embodiment, the neural network 140 is a CDNN that is initialized using Restricted Boltzmann Machines (RBM) training. Thereafter, suitable amount of training data at various signal-to-noise (SNR) is used to train the CDNN. In one embodiment, the input layer of the CDNN is fed magnitude spectrums (and derivative signals) of the accelerometer signal and acoustic signal. The target signal to the CDNN during the training process may be the magnitude spectrum of the clean speech. While operating in magnitude spectrum domain can greatly reduce computational complexity of training and operating a CDNN, another embodiment of input and output signals to the CDNN can include real and imaginary parts of the complex spectrums.

Referring back to FIG. 2, the microphone 120 may receive at least one of a near-end speaker signal and ambient noise signal and generate an acoustic signal while the accelerometer 120 may receive at least one of the near-end speaker signal and the ambient noise signal and generate an accelerometer signal. The neural network 140 receives the acoustic signal and the accelerometer signal and generates a speech reference signal based on the weight parameter set in the neural network 140. In one embodiment, the speech reference signal may include speech presence probabilities, artificial speech or artificial speech magnitude.

Figure 3:
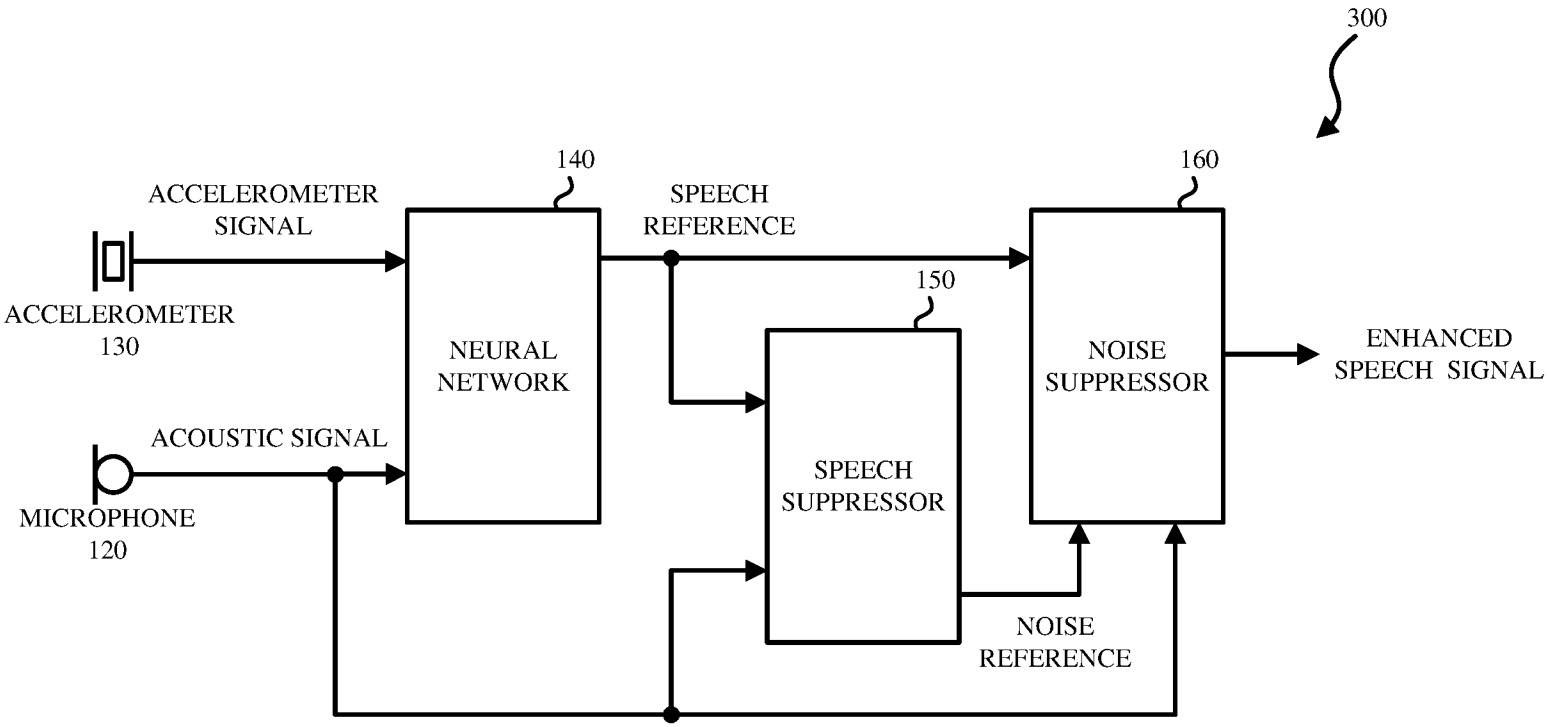
FIG. 3 illustrates a block diagram of a system for performing speech enhancement using a Neural Network based combined signal according to one embodiment of the invention.

FIG. 3 illustrates a block diagram of a system 300 for performing speech enhancement using a Neural Network based combined signal according to one embodiment of the invention. As shown in FIG. 3, the system 300 further adds on to the elements included in system 200 from FIG. 2. The system 300 further includes a speech suppressor 150 and a noise suppressor 160.

The speech suppressor 150 receives the speech reference signal from the neural network 140 and the acoustic signal from the microphone 120 and generates a noise reference signal using spectral subtraction. The noise reference signal may be a noise spectral estimate.

A typical speech suppressor could be described with the following equation $$SH_k = \frac{\sqrt{\pi v_k}}{2\gamma_k}\left\{\left|(1+v_k)I_0\left(\frac{v_k}{2}\right)+(v_k)I_1\left(\frac{v_k}{2}\right)\right|c^{-\left(\frac{v_k}{2}\right)}\right\} \tag{3}$$

Where $I_n(\ )$ is the modified Bessel function (MBF) of order n and where $v_k$ is defined as follow:

$$\left(\frac{v_k}{2}\right) \cong \frac{\zeta_k}{\zeta_k+1}\gamma_k$$

The function $\zeta_k$ is the a priori signal to noise ratio (SNR) and the function $\gamma_k$ is the a posterior SNR. They are given by $$\gamma_k \cong \frac{|x_k|^2}{|X[n,k]_k|^2}$$

$$\zeta_k \cong \frac{|\gamma_k|^2}{|X[n,k]_k|^2} \tag{4}$$

where the a priori signal-to-noise ratio is computed using the clean speech estimated using the output of the DNN, i.e., $X[n,k]_N$, N denotes the output of the final layer. Note, that in the EM type noise suppressor, if used for the speech suppression, $X[n,k]_N$ plays the role of the unwanted "noise-signal". In the speech suppressor the noise power is computed directly from the microphone signal. The speech suppressor, as the name implies, removes speech from the microphone signal and outputs a signal dominated with background noise.

The outputs of the speech suppressor is feed into a multichannel Noise suppressor described with the following equation:

$$NH_k = \frac{\sqrt{\pi v_k}}{2\gamma_k}\left\{\left|(1+v_k)I_0\left(\frac{v_k}{2}\right)+(v_k)I_1\left(\frac{v_k}{2}\right)\right|c^{-\left(\frac{v_k}{2}\right)}\right\} \tag{5}$$

Where $I_n(\ )$ is the modified Bessel function (MBF) of order n and where $v_k$ is defined as follow:

$$\left(\frac{v_k}{2}\right) \cong \frac{\zeta_k}{\zeta_k+1}\gamma_k$$

The function $\zeta_k$ is the a priori signal to noise ratio (SNR) and the function $v_k$ is the a posterior SNR. They are given by:

$$\left(\frac{v_k}{2}\right) \cong \frac{\zeta_k}{\zeta_k+1}\gamma_k$$

$$\zeta_k \cong \frac{|\gamma_k|^2}{|x_k|^2} \tag{6}$$

In this noise suppression stage, the a priori SNR is computed using the clean speech signal as estimated by the DNN, i.e., $X[n,k]_N$, and the noise estimated as outputted by the speech suppressor.

The noise suppressor 160 receives the acoustic signal from the microphone 120, the noise reference signal from the speech suppressor 150, and the speech reference signal from the neural network 140 and generates an enhanced speech signal. In one embodiment, the noise reference signal is fed into an Ephraim and Malah suppression rule based on a noise suppressor, which is optimal in the minimum mean-square sense error and colorless residual error. In some embodiments, the noise suppressor 160 is a multi-channel noise suppressor. In this embodiment, since the noise removal is carried out with a multi-channel noise suppressor, artifacts of spectral blending are never introduced.

Figure 4:
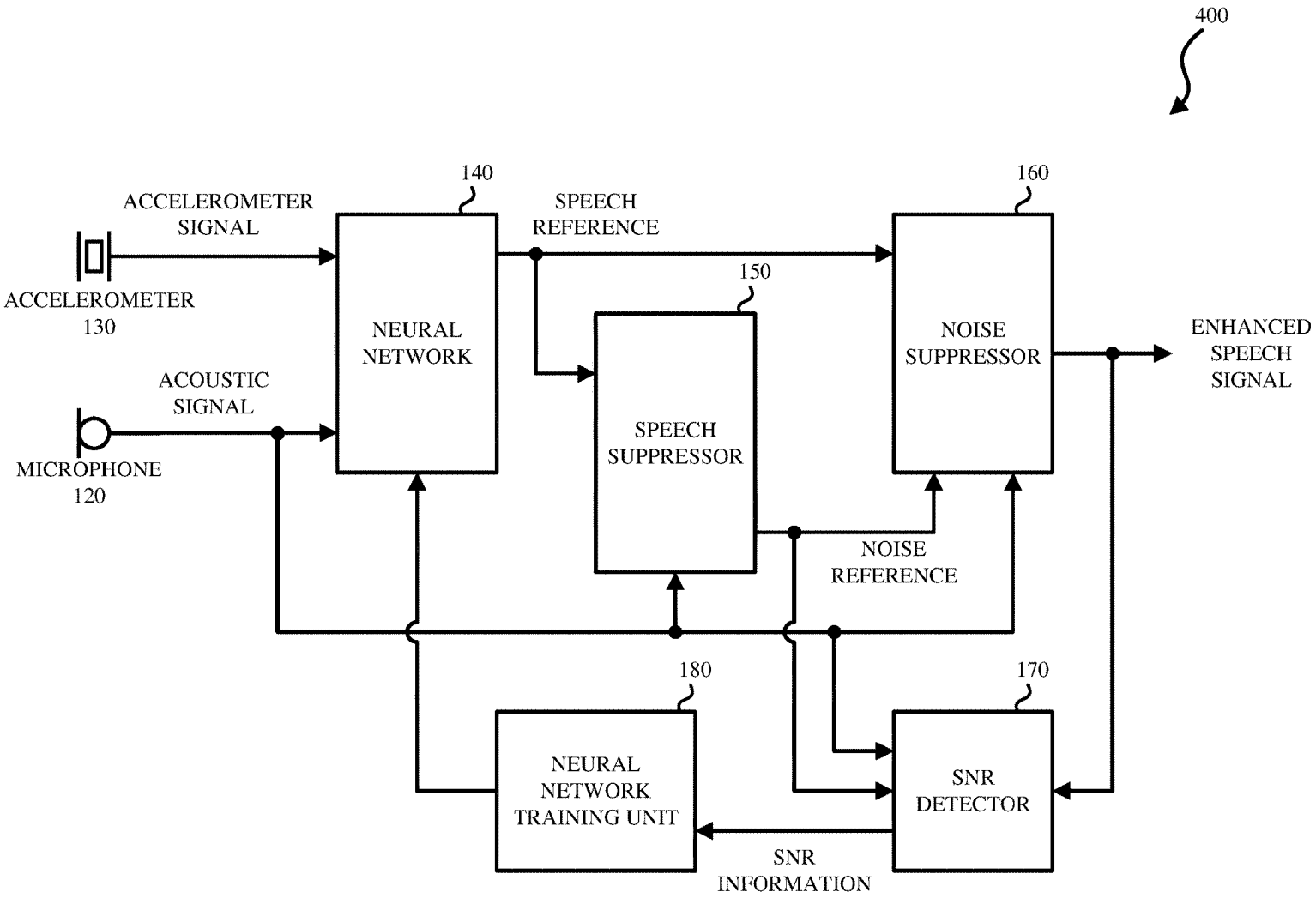
FIG. 4 illustrates a block diagram of a system for performing speech enhancement using a Neural Network based combined signal according to an embodiment of the invention.

FIG. 4 illustrates a block diagram of a system 400 for performing speech enhancement using a Neural Network based combined signal according to an embodiment of the invention. As shown in FIG. 4, the system 400 further adds on to the elements included in system 300 from FIG. 3. In this embodiment, the system 400 allows for in-the-field updates to the neural network 140. Accordingly, while the neural network 140 was trained offline using the training accelerometer signal and the training acoustic signal that are generated during clean speech segments, the neural network 140 may be trained in the in-the-field using a signal-to-noise ratio (SNR) detector 170 and a neural network training unit 180, that are included in system 400.

The SNR detector 170 receives the enhanced speech signal from the noise suppressor 160, the noise reference signal from the speech suppressor 150 and the acoustic signal from the microphone 120 to generate an SNR information signal.

The neural network training unit 180 receives the SNR information signal from the SNR detector 170, generates an update signal based on the SNR information signal, and transmits the update signal to the neural network 140 to cause updates to the weight parameter in the neural network 140. In one embodiment, the neural network training unit 180 causes in-the-field weight updates to the neural network.

In FIG. 4, the SNR detector 170 using the outputs from noise suppressor 160 in conjunction with speech suppressor 150 may constantly estimate the SNR conditions. In case of favorable SNR conditions, the enhanced speech is considered as a clean signal, and is mixed with noise at different levels by the SNR detector 170 and used by the neural network training unit 180 to slowly train the CDNN, resulting in an improved and user-personalized training over time.

Given that the systems 200, 300, 400, in FIGS. 2-4, do not require spectral blending, artifacts introduced by the spectral blending are avoided. While the accelerometer signal, the acoustic signal and the speech reference signal in the systems may be energy-based signals or complex signals including a magnitude and a phase component, the systems 200, 300, 400 process the signals without altering the phase and maintain the room impulse response effects (e.g., room signature is preserved).

Moreover, accelerometer 130 related artifacts are also suppressed due to nonlinear mapping of accelerometer signals into noise spectrum and further, when the noise suppressor 160 is a multi-channel noise suppressor. The accelerometer-microphone misadjustments in gain and impulse response are also removed, since the accelerometer 130 is being used as a more robust speech detector rather than as a better speech source, and the main signal path is the acoustic signal from the microphone 120. The decision to combine the accelerometer signal as a speech reference or in turn noise reference is trained into the neural network 140 (e.g., CDNN), which further requires minimal manual adjustments (user/developer level tunings).

The following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 5:
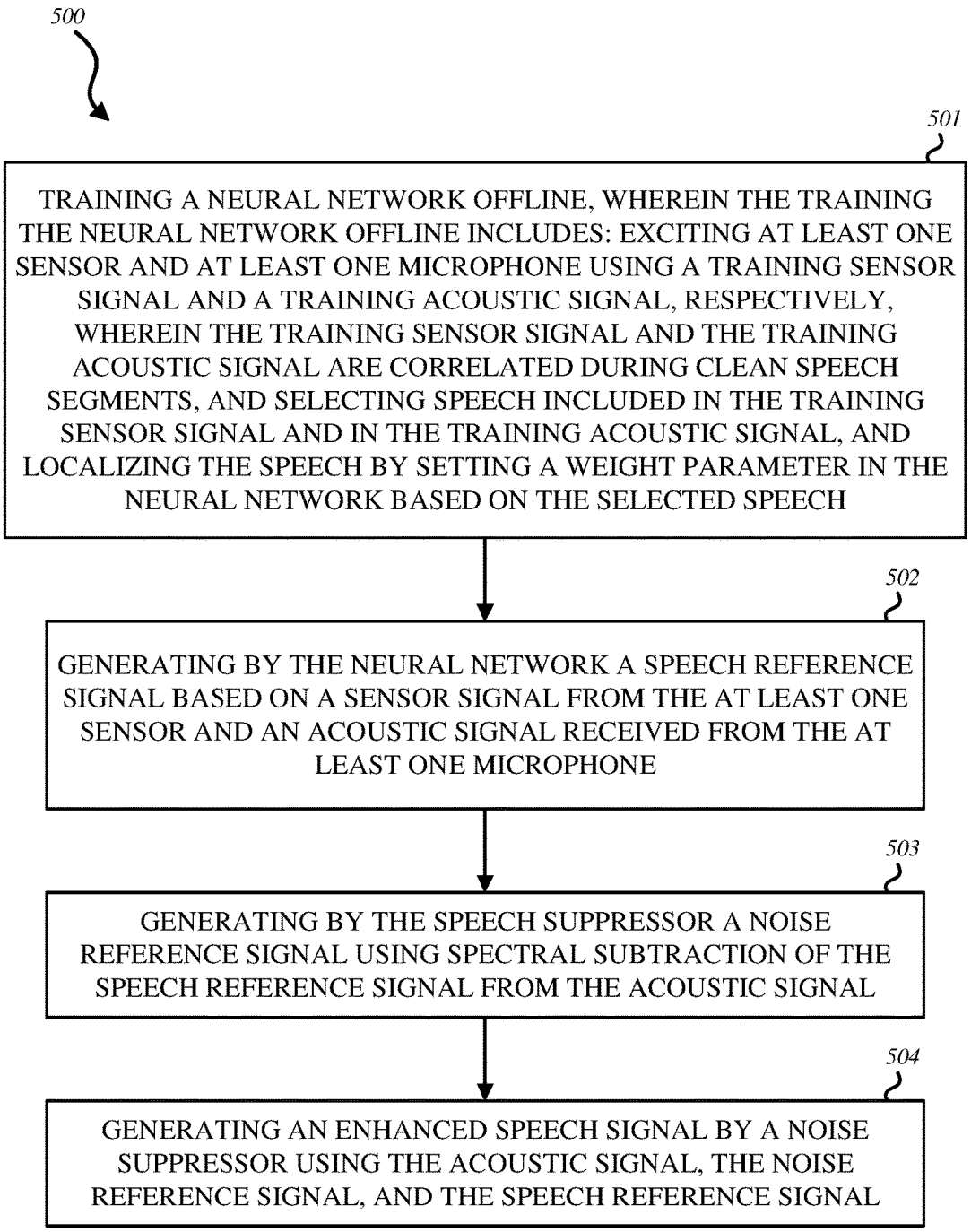
FIG. 5 illustrates a flow diagram of an example method for performing speech enhancement using a Neural Network based combined signal according to an embodiment of the invention.

FIG. 5 illustrates a flow diagram of an example method 500 for performing speech enhancement using a Neural Network based combined signal according to an embodiment of the invention.

The method 500 starts at Block 501 by training a neural network offline. In one embodiment, training the neural network offline includes: (i) exciting at least one accelerometer and at least one microphone using a training accelerometer signal and a training acoustic signal, respectively. The training accelerometer signal and the training acoustic signal are correlated during clean speech segments. Training the neural network offline also includes (ii) selecting speech included in the training accelerometer signal and in the training acoustic signal, and (iii) spatially localizing the speech by setting a weight parameter in the neural network based on the selected speech included in the training accelerometer signal and in the training acoustic signal. At Block 502, the neural network that has been trained offline generates a speech reference signal based on an accelerometer signal from the at least one accelerometer and an acoustic signal received from the at least one microphone. In one embodiment, the neural network generates the speech reference signal based on the weight parameter set in the neural network. The neural network provides spatial localization of features, weight sharing and subsampling of hidden units. In one embodiment, the speech reference signal includes at least one of: speech presence probabilities, artificial speech or artificial speech magnitude.

At Block 503, a speech suppressor generates a noise reference signal using spectral subtraction of the speech reference signal from the acoustic signal. At Block 504, a noise suppressor generates an enhanced speech signal using the acoustic signal, the noise reference signal, and the speech reference signal.

In one embodiment, the neural network may be updated in-the-field. In this embodiment, an SNR detector generates an SNR information signal using the enhanced speech signal, the noise reference signal, and the acoustic signal, a neural network training unit generates an update signal based on the SNR information signal, and transmits the update signal to the neural network. The neural network may update the weight parameter based on the update signal. In one embodiment, the neural network training unit causes in-the-field weight updates to the neural network.

Figure 6:
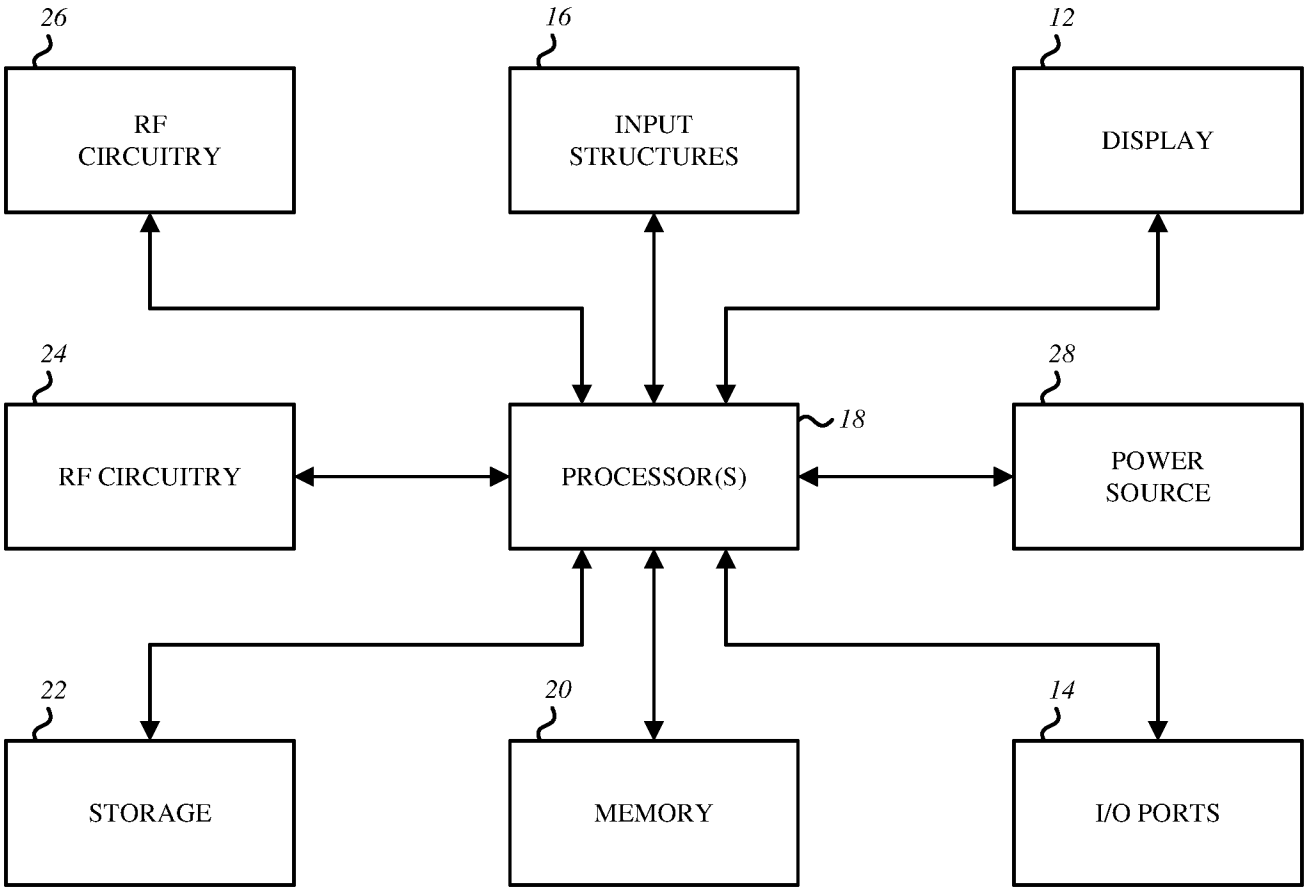
FIG. 6 is a block diagram of exemplary components of an electronic device included in the system in FIGS. 2-5 for performing speech enhancement using a Neural Network based combined signal in accordance with aspects of the present disclosure.

FIG. 6 is a block diagram of exemplary components of an electronic device included in the system in FIGS. 2-5 for performing speech enhancement using a Neural Network based combined signal in accordance with aspects of the present disclosure. Specifically, FIG. 6 is a block diagram depicting various components that may be present in electronic devices suitable for use with the present techniques. The electronic device 10 may be in the form of a computer, a handheld portable electronic device such as a cellular phone, a mobile device, a personal data organizer, a computing device having a tablet-style form factor, etc. These types of electronic devices, as well as other electronic devices providing comparable voice communications capabilities (e.g., VoIP, telephone communications, etc.), may be used in conjunction with the present techniques.

Keeping the above points in mind, FIG. 6 is a block diagram illustrating components that may be present in one such electronic device 10, and which may allow the device 10 to function in accordance with the techniques discussed herein. The various functional blocks shown in FIG. 6 may include hardware elements (including circuitry), software elements (including computer code stored on a computer-readable medium, such as a hard drive or system memory), or a combination of both hardware and software elements. It should be noted that FIG. 6 is merely one example of a particular implementation and is merely intended to illustrate the types of components that may be present in the electronic device 10. For example, in the illustrated embodiment, these components may include a display 12, input/ output (I/O) ports 14, input structures 16, one or more processors 18, memory device(s) 20, non-volatile storage 22, expansion card(s) 24, RF circuitry 26, and power source 28.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A system for performing speech enhancement using a Neural Network based combined signal comprising:

at least one microphone to receive at least one of a near-end speaker signal and ambient noise signal, and to generate an acoustic signal;

at least one accelerometer to receive at least one of the near-end speaker signal and the ambient noise signal, and to generate an accelerometer signal; and a neural network to receive the acoustic signal and the accelerometer signal, and to generate a speech reference signal, wherein the neural network is trained offline by:

exciting the at least one accelerometer and the at least one microphone using a training accelerometer signal and a training acoustic signal, respectively, wherein the training accelerometer signal and the training acoustic signal have speech segments, selecting speech included in the training accelerometer signal and in the training acoustic signal, and spatially localizing the speech by setting a weight parameter in the neural network based on the selected speech included in the training accelerometer signal and in the training acoustic signal.

2. The system of claim 1, wherein the neural network provides spatial localization of features, weight sharing and sub sampling of hidden units.

3. The system of claim 1, wherein the neural network generates the speech reference signal based on the weight parameter set in the neural network.

4. The system of claim 1, wherein the speech reference signal includes at least one of: speech presence probabilities, artificial speech or artificial speech magnitude.

5. The system of claim 1, wherein the neural network is a multilayer perception (MLP) neural network or a convolution deep neural network (CDNN).

6. The system of claim 1, further comprising:

a speech suppressor to receive the speech reference signal and the acoustic signal, and to generate a noise reference signal using spectral subtraction; and a noise suppressor to receive the acoustic signal, the noise reference signal, and the speech reference signal, and to generate an enhanced speech signal.

7. The system of claim 6, further comprising:

a signal-to-noise ratio (SNR) detector that receives the enhanced speech signal, the noise reference signal and the acoustic signal to generate an SNR information signal; and a neural network training unit that receives the SNR information signal, generates an update signal based on the SNR information signal, and transmits the update signal to the neural network to cause updates to the weight parameter in the neural network.

8. The system of claim 7, wherein the neural network training unit causes in-the-field weight updates to the neural network.

9. A method of speech enhancement using a Neural Network based combined signal comprising:

training a neural network offline, wherein training the neural network offline includes:

exciting at least one accelerometer and at least one microphone using a training accelerometer signal and a training acoustic signal, respectively, wherein the training accelerometer signal and the training acoustic signal are correlated during clean speech segments, selecting speech included in the training accelerometer signal and in the training acoustic signal, and spatially localizing the speech by setting a weight parameter in the neural network based on the selected speech included in the training accelerometer signal and in the training acoustic signal; and generating by the neural network a speech reference signal based on an accelerometer signal from the at least one accelerometer and an acoustic signal received from the at least one microphone.

10. The method of claim 9, wherein the neural network provides spatial localization of features, weight sharing and subsampling of hidden units.

11. The method of claim 9, wherein the neural network generates the speech reference signal based on the weight parameter set in the neural network.

12. The method of claim 9, wherein the speech reference signal includes at least one of: speech presence probabilities, artificial speech or artificial speech magnitude.

13. The method of claim 9, wherein the neural network is a multilayer perception (MLP) neural network or a convolution deep neural network (CDNN).

14. The method of claim 9, wherein the at least one microphone receives at least one of a near-end speaker signal and ambient noise signal and generates an acoustic signal, and wherein the at least one accelerometer receives at least one of the near-end speaker signal and the ambient noise signal, and generates the accelerometer signal.

15. The method of claim 9, further comprising generating by a speech suppressor a noise reference signal using spectral subtraction of the speech reference signal from the acoustic signal; and generating an enhanced speech signal by a noise suppressor using the acoustic signal, the noise reference signal, and the speech reference signal.

16. The method of claim 15, further comprising:

generating by a signal-to-noise ratio (SNR) detector an SNR information signal using the enhanced speech signal, the noise reference signal and the acoustic signal; and generating by a neural network training unit an update signal based on the SNR information signal; and transmitting the update signal to the neural network.

17. The method of claim 16, further comprising:

updating by the neural network the weight parameter based on the update signal.

18. The method of claim 17, wherein the neural network training unit causes in-the-field weight updates to the neural network.

19. A computer-readable non-transitory storage medium have stored thereon instructions, which when executed by a processor, causes the processor to perform a method of speech enhancement using a Neural Network based combined signal comprising:

training a neural network offline, wherein training the neural network offline includes:

exciting at least one accelerometer and at least one microphone using a training accelerometer signal and a training acoustic signal, respectively, wherein the training accelerometer signal and the training acoustic signal are correlated during clean speech segments, selecting speech included in the training accelerometer signal and in the training acoustic signal, and spatially localizing the speech by setting a weight parameter in the neural network based on the selected speech included in the training accelerometer signal and in the training acoustic signal; and causing the neural network to generate a speech reference signal based on an accelerometer signal from the at least one accelerometer and an acoustic signal received from the at least one microphone.

20. The computer-readable storage medium of claim 19, having stored therein instructions, when executed by the processor, causes the processor to perform the method further comprising:

generating a noise reference signal using spectral subtraction of the speech reference signal from the acoustic signal; and generating an enhanced speech signal using the acoustic signal, the noise reference signal, and the speech reference signal.

21. The computer-readable storage medium of claim 20, having stored therein instructions, when executed by the processor, causes the processor to perform the method further comprising:

generating an SNR information signal using the enhanced speech signal, the noise reference signal and the acoustic signal; and generating an update signal based on the SNR information signal;

transmitting the update signal to the neural network; and causing the neural network to update the weight parameter based on the update signal.

* * * * *